United States Patent [19]

Coltman, Jr.

[11] 4,426,014

[45] Jan. 17, 1984

[54] CLOSURE FOR OPEN MOUTH CONTAINER

[75] Inventor: Bertram W. Coltman, Jr., Winnetka, Ill.

[73] Assignee: Republic Molding Corporation, Chicago, Ill.

[21] Appl. No.: 427,560

[22] Filed: Sep. 29, 1982

[51] Int. Cl.[3] ..... B65D 39/00

[52] U.S. Cl. ..... 220/307; 220/DIG. 19; 215/DIG. 1

[58] Field of Search ..... 220/307, DIG. 19; 215/DIG. 1; 150/0.5; 222/484, 563

[56] References Cited

U.S. PATENT DOCUMENTS

| | | | |
|---|---|---|---|
| D. 226,576 | 3/1973 | Swett et al. | D44/1 B |
| D. 227,142 | 6/1973 | Swett et al. | D44/21 R |
| 1,651,669 | 12/1927 | Carpmael . | |
| 1,732,834 | 10/1929 | Carpmael . | |
| 2,024,495 | 12/1935 | Wolfe | 220/59 |
| 2,049,228 | 7/1936 | Sebell | 220/60 |
| 2,487,400 | 11/1949 | Tupper | 150/0.5 |
| 2,487,635 | 11/1949 | Carpenter | 4/295 |
| 2,630,237 | 3/1953 | Rosenlof | 220/24 |
| 2,659,509 | 11/1953 | Fong | 215/40 |
| 2,671,574 | 12/1950 | Wolfe | 220/24.5 |
| 2,688,995 | 9/1954 | Wagoner | 150/0.5 |
| 2,913,140 | 11/1959 | Vuillemenot | 220/60 |
| 3,023,926 | 3/1962 | Wilke | 220/60 |
| 3,042,247 | 7/1962 | Bonnet | 220/44 |
| 3,055,536 | 9/1962 | Dieny | 220/44 |
| 3,070,257 | 12/1962 | Bojanowski | 220/97 |
| 3,081,904 | 3/1963 | Pipes | 220/60 |
| 3,111,240 | 11/1963 | Whitton, Jr. | 220/67 |
| 3,133,666 | 5/1964 | Henchert | 220/60 |
| 3,142,409 | 7/1964 | Ross | 220/24.5 |
| 3,156,372 | 11/1964 | Parker | 220/24 |
| 3,216,148 | 11/1965 | Amberg | 43/55 |
| 3,244,308 | 4/1966 | Esposito, Jr. | 215/52 |
| 3,343,700 | 9/1967 | Heubl | 215/41 |
| 3,362,575 | 1/1968 | Fotos | 220/97 |
| 3,380,610 | 4/1968 | Krieps | 215/41 |
| 3,415,405 | 12/1968 | Rausing et al. | 215/48 |
| 3,519,163 | 7/1970 | Bardell | 220/60 |
| 3,599,821 | 8/1971 | Eggert et al. | 215/52 |
| 3,679,089 | 7/1972 | Swett et al. | 220/42 |
| 3,692,208 | 9/1972 | Croyle et al. | 220/24.5 |
| 3,719,304 | 3/1973 | Douglas | 220/42 C |
| 3,756,480 | 9/1973 | Swett et al. | 220/484 |
| 4,227,625 | 10/1980 | Underwood | 220/307 |
| 4,307,817 | 12/1981 | Cotreneo | 220/307 |
| 4,333,584 | 6/1982 | Gall | 220/309 |

FOREIGN PATENT DOCUMENTS

| | | |
|---|---|---|
| 257559 | 5/1963 | Australia . |
| 1115331 | 4/1956 | France . |
| 1140556 | 7/1957 | France . |
| 1030117 | 5/1966 | United Kingdom . |

*Primary Examiner*—George T. Hall

*Attorney, Agent, or Firm*—Mason, Kolehmainen, Rathburn & Wyss

[57] ABSTRACT

A closure of flexible molded plastic material is adapted to seal around the mouth at the open end of a storage container and comprises a main closure wall having an outer periphery and an inside surface adapted to span across and close the container mouth when inserted into the open end. The main closure wall includes a central portion deflectable inwardly toward an opposite end of the container when initiating a seal across the open end thereof. A peripheral flange is formed around the main closure wall to extend transversely away from the inside surface and includes a deflectable depending skirt having a free end portion spaced outwardly of an outer peripheral edge and the inside surface of the main closure wall separated therefrom by an annular groove. When the closure is inserted into the open mouth of the container, the central portion is depressed and a free end portion of the skirt establishes a continuous air tight peripheral seal around the mouth of the container to provide an air tight storage environment for the contents.

15 Claims, 5 Drawing Figures

CLOSURE FOR OPEN MOUTH CONTAINER

BACKGROUND OF THE INVENTION

1. Field of the Invention

The present invention relates to a closure formed of flexible molded plastic material adapted to seal around the mouth at the open end of a storage container and more specifically is directed towards a closure and container combination especially adapted for storing foods and the like in an air-tight enclosure in freezers, refrigerators, etc.

2. The Background Art

A wide variety of closures and open mouth containers have been developed for use in storing foods and other perishable items in an air-tight environment in refrigerators, freezers, general storage areas and other locations. One such closure and container combination is manufactured and sold by the Republic Molding Corporation of Chicago, Ill. under the trademark FREEZETTE and FREEZETTE II and features a push-pull lid or closure designed to provide an air-tight storage environment when inserted into the open mouth of the container. The closure is easily inserted and is easily removable by lifting a flange, a portion of which is exposed for convenient grasping by the fingers.

OBJECTS OF THE INVENTION

It is an object of the present invention to provide a new and improved closure formed of flexible material adapted to seal around the mouth at an open end of a storage container. In particular, it is an object of the present invention to provide a new and improved closure of the character described adapted to provide an air tight environment for closing a container suitable for use in refrigerators, freezers and other storage locations.

Another object of the present invention is to provide a new and improved closure and container combination of the character described wherein the closure is insertable into the open mouth at one end of the container and is sealed around the periphery to provide an air-tight enclosure for storing food and other items.

Another object of the present invention is to provide a new and improved closure/container combination of the character described wherein the closure includes a flexible, depending skirt which is effective to maintain an air-tight seal when the closure is fully inserted into the open end of the container.

Another object of the present invention is to provide a new and improved closure/container combination which produces an audible sound when the closure is inserted into the container to establish an air-tight seal.

Another object of the present invention is to provide a new and improved closure/container combination wherein the closure and container are formed of molded plastic materials having different coefficients of expansion.

Still another object of the present invention is to provide a new and improved closure/container combination of the preceeding object especially adapted for maintaining an air-tight seal when subjected to a temperature that is greatly reduced from the temperature at the time that an initial seal is established.

Still another object of the present invention is to provide a new and improved closure container combination which is neat and appealing in appearance, relatively low in cost, easy to seal and unseal, and especially well suited for providing an air-tight storage vessel for food and the like placed in refrigerators, freezers, etc.

BRIEF SUMMARY OF THE INVENTION

The foregoing and other objects and advantages of the present invention are accomplished in a new and improved closure formed of flexible molded plastic material especially adapted to provide an air-tight seal around the mouth at the open end of a storage container suitable for use in refrigerators, freezers, etc.

The closure includes a main closure wall having an outer periphery and an inside surface which is adapted to span across and close the open mouth of the container when the enclosure is inserted therein. The main closure wall includes a central portion which is deflected inwardly towards an opposite end or bottom of the container to establish an air-tight peripheral seal around the container mouth. A peripheral flange is integrally joined to the main closure wall around the periphery and extends tranversely away from the inside surface. The flange includes a deflectable, depending skirt having a free end portion spaced outwardly of an outer peripheral edge of the inside surface of the main closure wall and separated therefrom by an annular groove. The depending free end of the skirt is adapted to establish a continuous peripheral seal around the mouth at the open end of the container when the closure is inserted and the central portion is deflected inwardly to engage the seal.

BRIEF DESCRIPTION OF THE DRAWINGS

For better understanding of the present invention reference should be had to the following detailed description taken in conjunction with the drawing, in which.

DESCRIPTION OF A PREFERRED EMBODIMENT

Referring now more particularly to the drawings, in FIGS. 1–4 is illustrated a new and improved closure 10 especially adapted for insertion into the open mouth at the upper end of a container 12 in order to provide an air tight, sealed enclosure for storing foods and the like in refrigerators, freezers and other storage environments. Preferrably the closure and container are formed of molded flexible plastic material and the formulation of the material is such that the material of the closure 10 has a higher coefficient of expansion and contraction than the material of the container 12.

Figure 3:
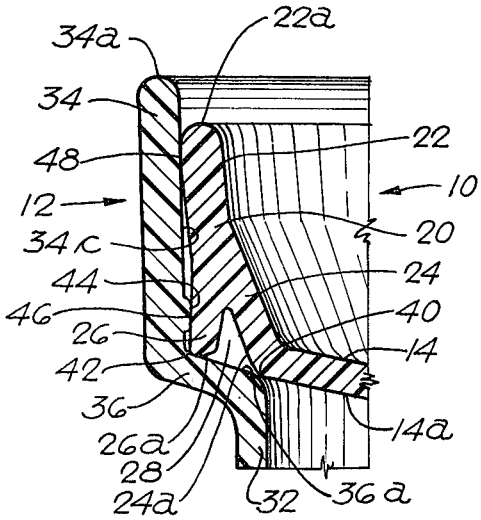
FIG. 3 is a cross sectional view similar to FIG. 2, but in smaller scale illustrating the closure when fully inserted into the open end of the container to provide an air-tight continuous seal around the mouth thereof.

The closure is provided with an annular main closure wall 14 having a lower or inside surface **14*a* adapted to span and close the upper, open end of the container to provide an air-tight storage vessel. As indicated in the drawings, the main closure wall 14 is inwardly concave toward the lower surface or underside 14***a* but includes an upstanding, outwardly concave, raised central portion 16 adapted to handle inwardly directed finger or hand pressure (indicated by the arrow 18 in FIG. 1) used for establishing an air tight seal around the periphery of the closure when fully inserted into the container as shown in FIG. 3.

Figure 2:
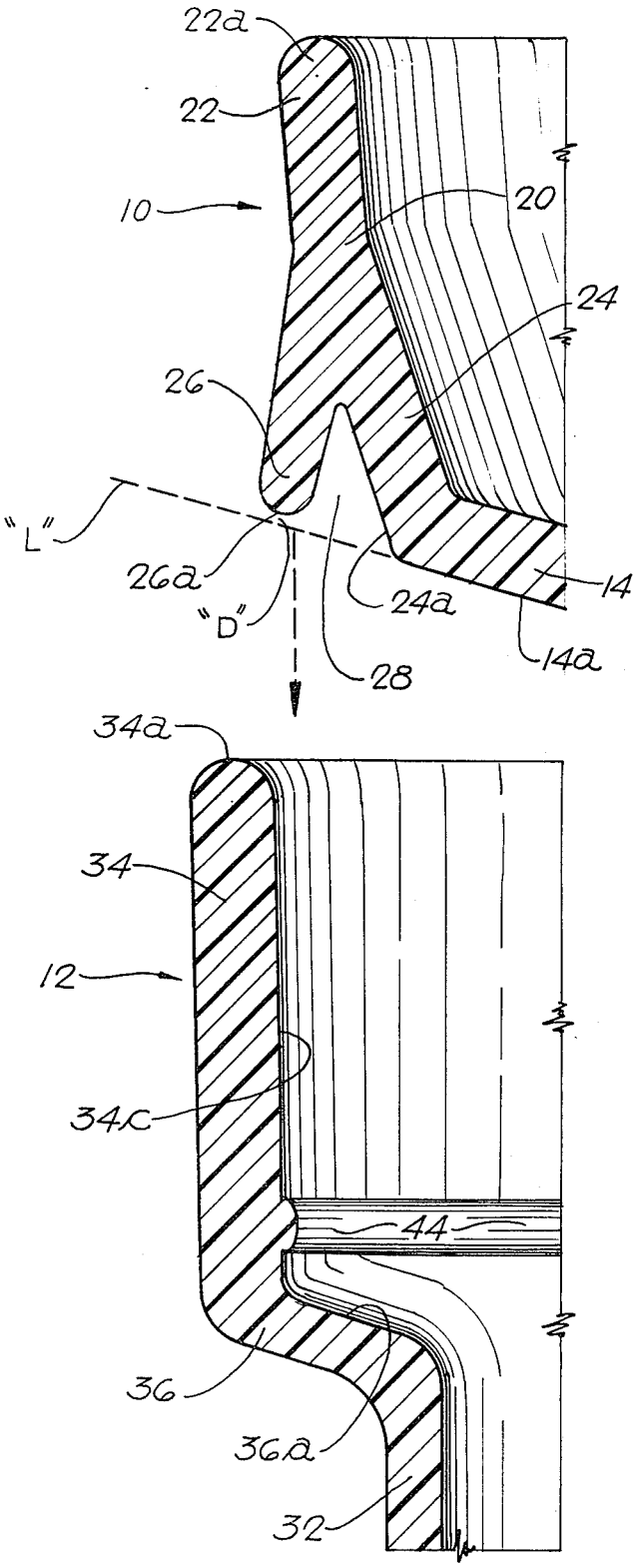
FIG. 2 is a greatly enlarged, fragmentary cross sectional view taken substantially along lines 2—2 of FIG. 1.
Figure 4:
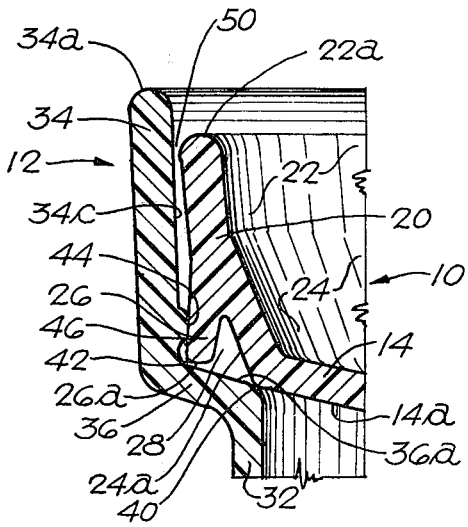
FIG. 4 is fragmentary cross sectional view similar to FIG. 3, but illustrating the closure and container after storage at a reduced temperature has taken place.

Around the outer peripheral edge of the main closure wall 14 there is formed an integral, outwardly upstanding peripheral flange 20 having a free upper end portion 22 with a smoothly rounded outer end 22*a*. The flange includes an intermediate wall section 24 of frustoconical shape sloping downwardly and inwardly from the free upper end portion to integrally join the outer periphery of the main closure wall 14 at a transverse sloping angle as best shown in FIGS. 2, 3 and 4. The free outer end segment 22 of the flange 20 is frustoconical in shape and diverges upwardly and outwardly at a shallow slope or angle from the upper edge of the generally frustoconical intermediate flange segment 24. The flange 20 also includes a skirt 26 having a downwardly projecting, frustoconical free end terminating in a rounded lower end surface 26*a*. The end surface 26*a* is spaced apart from an outside surface 24*a* of the intermediate flange wall 24 and an upwardly extending annular groove or recess 28 is formed between the skirt and surface 24*a* to extend around the periphery of the closure 10.

Figure 1:
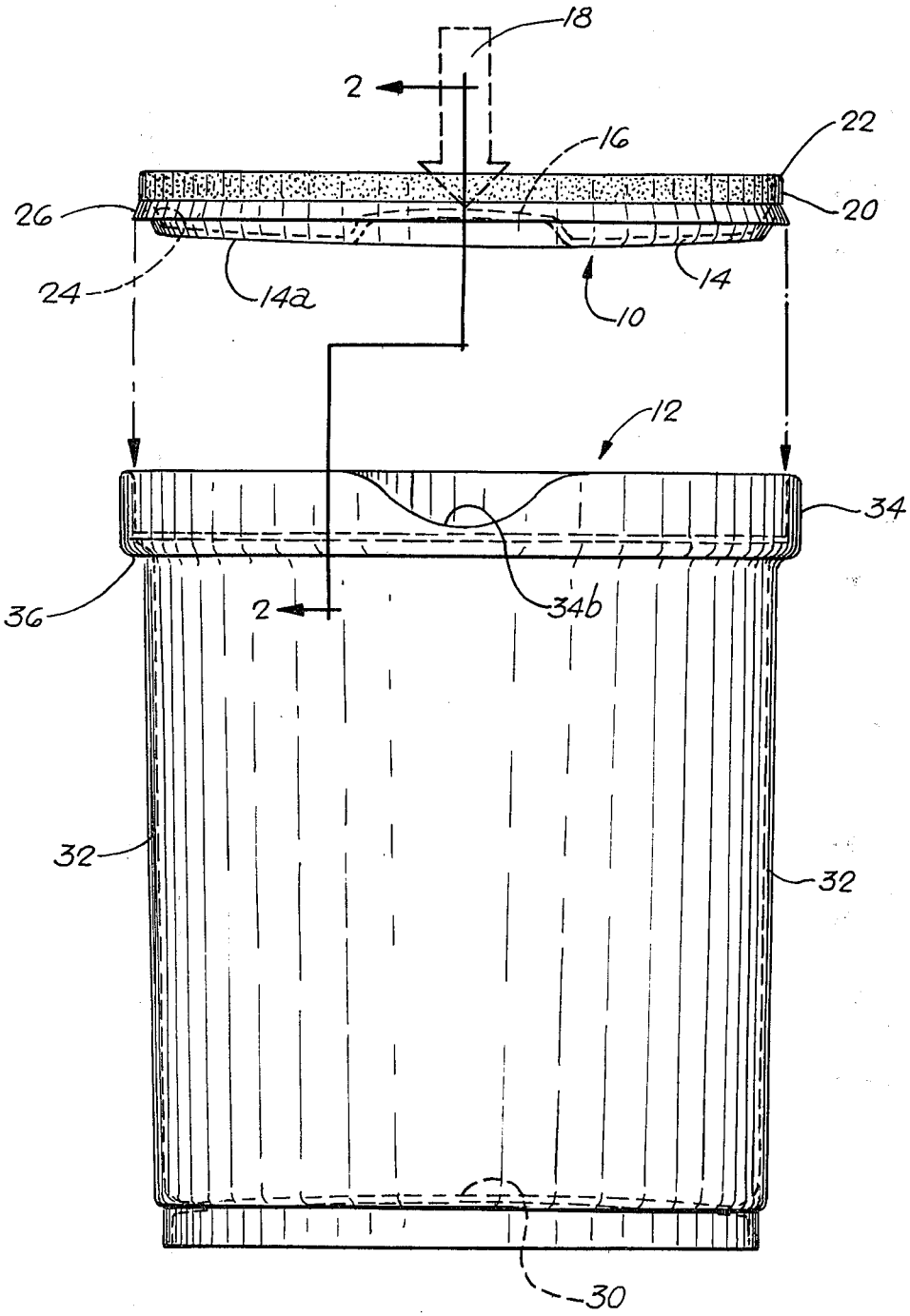
FIG. 1 is a side elevational view of a closure and container constructed in accordance with the features of the present invention.

The free lower end portion of the depending skirt 26 is flexible to move toward and away from the somewhat thicker intermediate wall segment 24 of the flange and is especially adapted to provide a continuous, peripheral, air-tight seal when the closure 10 is inserted into the open end of the container 12. An outside surface of the depending skirt is generally frustoconical in shape as illustrated in FIGS. 1 and 2, and the lower end surface 26*a* of the skirt terminates at a level spaced above the junction of the intermediate flange segment 24 and the main closure wall 14. As shown in FIG. 2, a slight space or distance "D" is provided between the lower end surface 26*a* of the depending skirt and a projecting line "L" which is contiguous with and extends outwardly from the underside or inside surface 14*a* of the main closure wall 14.

The relief or void provided by the annular groove 28 between the intermediate flange wall 24 and the depending skirt 26 permits flexibility of the skirt so that the depending lower end portion can readily form a flexible, but effective air-tight seal against the adjacent container wall surface when the closure 10 is fully inserted downwardly into the open end of the container 12.

The container is generally cylindrical in shape and includes an integral bottom wall 30 which is inwardly and upwardly concave. The bottomwall joins a continuous upstanding peripheral side wall 32 having an enlarged diameter open upper end wall or mouth 34 with a rounded upper end 34*a* as best shown in FIG. 2. As illustrated in FIG. 1, a portion of the wall forming the open mouth is cut away forming a recess 34*b* to facilitate grasping of the exposed flange 20 of the closure 10 for unsealing and removal of the closure from the container when desired.

The enlarged diameter open end or mouth 34 includes an inside surface 34*c* of frustoconical shape sloping upwardly and outwardly at a small angle from a lower end portion which is integrally joined to a step or annular shoulder wall 36 of frustoconical shape having an upwardly facing surface 36*a* which provides an annular seating surface for contact with the undersurface 14*a* of the closure. As best shown in FIGS. 3 and 4, the angle of slope of the concave main closure wall undersurface 14*a* around the periphery thereof is closely matched to the slope of the seating surface 36*a* of the shoulder wall 36 so that when the closure 10 is fully inserted, a continuous annular ring or sealing area 40 is established between the surface 14*a* of the closure and the shoulder surface 36*a* of the container.

In addition, a second area of sealing 42 is established between the the lower end surface 26*a* of the depending skirt and the surface 36*a* of the shoulder adjacent the outer periphery thereof. The outer seal area 42 is concentric to the inner seal area 40 and further aids in establishing and maintaining an air tight seal when the closure 10 is fully inserted into the open upper end of the container 12.

The inside surface 34*c* of the mouth wall 34 is provided with an inwardly projecting, integrally formed rib 44 spaced upwardly from the upper shoulder surface 36*a*. The inner diameter of the rib 44 is slightly less than the diameter of the adjacent, outer surface of the depending skirt 26. A slight dimensional interference is provided between the skirt and rib to affect a third concentric area of sealing 46 established between the inner surface of the rib and the outer surface of the depending skirt 26 of the fully inserted closure 10.

The rib 44 also functions to provide an audible signal or "snapping sound" as the lower end portion 26*a* of the depending skirt 26 passes down across the rib during downward insertion of the closure into the open mouth 34 of the container. This audible "snapping sound" lets one know that a good seal has been established.

Referring now to FIG. 3, when the closure is fully inserted, an inner annular seal area 40 is established between the underside 14*a* of the closure and an inner ring area on the upper surface 36*a* of the shoulder wall. A second concentric outer annular seal area 42 is also established as the lower end 26*a* of the depending closure skirt 26 seats against an outer ring area on the upper shoulder wall surface 36*a*. A third concentric annular sealing area 46 is established between the rib 44 and the outer surface of the skirt 26 to provide further insurance of an air-tight seal. An audible signal or "snapping sound" is generated as the lower edge of the skirt passes the rib and snaps back outwardly against the wall surface of the mouth which is undercut between the rib and the shoulder wall and the sound indicates that a seal has been established. A fourth concentric sealing area 48 (FIG. 3) is established between an upper portion of the flange section 22 and the adjacent inside surface 34*c* of the enlarged mouth wall 34 of the container.

Referring momentarily to FIG. 4, when a sealed closure/container is placed in a refrigerator or freezer and the temperature is reduced from the temperature prevalent during initial closure, the upper portion of the outer flange wall 22 may tend to pull away slightly from the inside surface 34*c* of the open upper end wall 34 forming a slight gap 50, FIG. 4. This slight amount of "pull away" is believed to be caused by thermal contraction due to lowering of the temperature but tends to cause the outer surface of the lower depending skirt 26 to move in an outward direction providing an even tighter seal against the inside surface of the rib 44 and the container mouth 34. This sealing action is believed to be a result of the fact that the closure 10 is formed of material having a greater coefficient of expansion and contraction than the material used in the container 12, and because of the shape of the free depending end and generally frustoconical shape of the flange 26 of the closure.

Thus, once the closure 10 is fully inserted in the container, and the sealing areas 40, 42 46 and 48 are established and the air-tight container is placed in a refrigerator or freezer. As the temperature is reduced, the air-tight seal is continuously maintained even though the upper end of the flange 22 may pull away slightly from the adjacent inside surface 34*c* of the mouth 34 of the container wall. An even tighter seal or closure is established between the internal rib 44 and the outer surface of the depending skirt 26, but in any event a continuing air-tight seal is maintained until the closure 10 is removed from the container 12 by upward pull.

The flange 20 of the closure 10 is dimensioned so that the outer or maximum diameter portion of the skirt 26 is slightly larger than the inside diameter of the surface 34*c* below the rib 44. Similarly a slight amount of interference may be provided between the outer surface of the upper end portion of the flange 22 and the adjacent inside surface 34*c* near the rounded upper end 34*a* of the container mouth 34.

Figure 5:
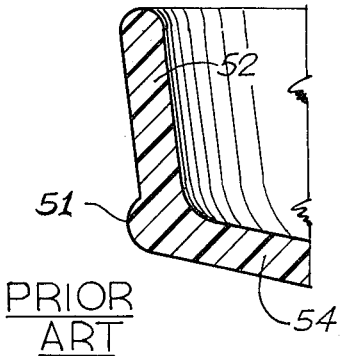
PRIOR ART FIG. 5
FIG. 5 is a fragmentary cross sectional view of a prior art closure.

FIG. 5 represents a prior art closure or lid having a slight bulge or rounded outer projecting corner 50 adjacent the juncture of an upstanding flange 52 and an inwardly concave main closure wall 54.

Although the present invention has been described with reference to a single illustrated embodiment thereof, it should be understood that numerous other modifications and embodiments can be made by those skilled in the art that will fall within the spirit and scope of the principles of this invention.

What is claimed as new and is desired to be secured by Letters Patent is:

1. A closure formed of flexible molded plastic material and adapted to seal around the mouth at the open end of a storage container, comprising:

a main closure wall having an outer periphery and an inside surface adapted to span across and close said container mouth when said closure is inserted into said open end of said container, said main closure wall including a central portion deflectable inwardly toward an opposite end of said container, and a peripheral flange integrally joined with said main closure wall around the periphery thereof and extended transversely away from said inside surface, said flange including a deflectable, depending skirt having a free end portion spaced outwardly of an outer peripheral edge of said inside surface of said main closure wall and separated therefrom by a groove, said depending free end portion of said skirt establishing a continuous peripheral seal around the mouth of said open end of said container when said closure is inserted into said container and said inside surface is moved toward contact against said open end of said container by inward deflection of said central portion main closure wall.

2. The closure of claim 1 wherein said peripheral flange includes a free outer end portion extending in a direction generally opposite said depending free end portion of said skirt, said depending free end portion of said skirt sloping outwardly away from an outer surface of said free outer end portion of said flange.

3. The closure of claim 2 wherein said peripheral flange includes an intermediate portion integrally joining said free outer end portion of said peripheral flange and said main closure wall, said intermediate portion sloping inwardly away from said depending said free end portion of said skirt to define said groove therebetween.

4. The closure of claims 1, 2 or 3 wherein said main closure wall is inwardly concave toward said inside surface.

5. The closure of claim 4 wherein said central portion of said main closure wall is outwardly convex away from said inside surface.

6. The closure of claim 3 wherein said intermediate portion extends inwardly to join said main closure wall at a level inwardly away from the free end of said depending skirt.

7. The closure of claim 1 in combination with said container wherein said container is formed with an enlarged mouth at said open end having an inside surface dimensioned to receive said closure inserted therein to form a continuous seal with said depending free end of said skirt.

8. The combination of claim 7 wherein said container includes a shoulder defined between said enlarged mouth and a main body thereof, said shoulder providing a stop for limiting the inward travel of said closure when inserted into said open end of said container and providing a second peripheral seal with an outer edge portion of said inside surface of said main closure wall.

9. The combination of claim 8 wherein said container includes an inwardly extending rib formed on said inside surface of said enlarged mouth and spaced from said shoulder, said rib being engagable with said depending free end of said skirt upon insertion of said closure into said open end of said container to form said seal around said mouth.

10. The combination of claim 9 wherein said rib includes an inwardly facing surface dimensioned to engage and inwardly deflect said free end of said depending skirt upon insertion of said closure into said open end of said container.

11. The combination of claim 10 wherein said free end of said depending skirt snaps outwardly toward engagement against said inside surface of said enlarged mouth when passing said rib on insertion of said closure into said open end of said container.

12. The combination of claim 7 wherein said container is formed of flexible molded plastic material.

13. The combination of claim 12 wherein said closure and said container are formed of molded plastic material having different coefficients of expansion.

14. The combination of claim 13 wherein said material of said closure has a greater coefficient of expansion than that of the material of said container.

15. The combination of claim 13 wherein said free end of said depending skirt of said closure is dimensioned to maintain a continuous seal against an inside surface of said enlarged open mouth of said container when said closure and container are reduced in temperature after initially inserting said closure into said enlarged mouth to establish said seal.

* * * * *